United States Patent [19]

Bard et al.

[11] 4,414,872

[45] Nov. 15, 1983

[54] LENS TAPE CUTTER

[75] Inventors: George D. Bard, Brooklyn, Conn.; Robert J. Dusza, Southbridge, Mass.

[73] Assignee: American Optical Corporation, Southbridge, Mass.

[21] Appl. No.: 258,720

[22] Filed: Apr. 29, 1981

[51] Int. Cl.[3] ..... B26F 3/12

[52] U.S. Cl. ..... 83/171; 83/564; 83/651.1; 83/914

[58] Field of Search ..... 83/16, 171, 651.1, 914, 83/588, 564; 30/140; 53/390, 372

[56] References Cited

U.S. PATENT DOCUMENTS

| | | | |
|---|---|---|---|
| 2,759,618 | 8/1956 | Vogt | 83/171 X |
| 2,864,221 | 12/1958 | Jones, Jr. et al. | 53/372 |
| 3,177,748 | 4/1965 | Rosenthal | 53/590 |
| 3,479,789 | 11/1969 | Harrison | 53/372 X |
| 3,540,336 | 11/1970 | Kelsey | 83/171 |
| 3,752,725 | 8/1973 | Freeman | 83/171 X |
| 3,754,489 | 8/1973 | Carver et al. | 83/171 X |
| 3,772,850 | 11/1973 | Fujiwara | 53/390 X |
| 4,279,113 | 7/1981 | Halm | 53/390 X |

FOREIGN PATENT DOCUMENTS

| | | | |
|---|---|---|---|
| 2052195 | 4/1972 | Fed. Rep. of Germany | 83/171 |
| 647276 | 12/1950 | United Kingdom | 83/171 |

*Primary Examiner*—James M. Meister
*Attorney, Agent, or Firm*—Kenway & Jenney

[57] ABSTRACT

A lens surface is taped for protection during second side finishing and excess tape is trimmed from the lens with a heated cutting wire.

2 Claims, 3 Drawing Figures

LENS TAPE CUTTER

BACKGROUND OF THE INVENTION

1. Field of the Invention

This invention relates to lens surface protecting procedures with particular reference to protection by taping and removal of excess tape for subsequent lens processing.

2. Description of the Prior Art

Optically finished surfaces of ophthalmic lens blanks requiring second side finishing are traditionally protected from scratching and other damage with variously applied coatings including a transparent or translucent adhesive tapes which help metal alloy used in blocking adhere to the lens blanks. The tape, being of a width greater than the maximum diameter of the lens, is usually drawn from a supply role over a lens to be covered and seated thereagainst by urging the tape and lens one toward the other.

The taped lens must then be cut away from the tape supply and/or excesses of tape at its edges prior to preparation for second side machining and polishing.

Heretofore, excesses of tape have been trimmed from taped lenses with various mechanical cutters which are required to first pierce the tape and then be so manipulated as to produce a sawing or rotary or similar cutting action about the lens edge.

With the presently available ease and rapidity of initial application of tape to lenses, i.e. as afforded by current tape dispensers and applicators, it can be appreciated that tape trimming operations such as the above become bottlenecking to production. They are unduly time-consuming, awkward and tedious. Special attention and skills are required for implementation and consistency of position of cut around lens edges.

Accordingly, it is an object of the present invention to facilitate the trimming of taped lenses, i.e. to provide for greater ease of implementation and accuracy of size, shape and position of cut.

Another object is to accomplish the above with unusual rapidity and without need for special skills;

Still another object is to provide tape cutting means which is readily adaptable to hand or machine operation.

Other objects and advantages of the invention will become readily apparent from the following description.

SUMMARY OF THE INVENTION

Objects and advantages of the invention are accomplished with a cutter comprising an annular electrically heated wire. A holder supports the wire annulus and facilitates its handling.

The wire annulus, having a diameter greater than the diameter or maximum width of a lens to be trimmed, is placed over a taped lens against overhanging portions of the tape which become severed by heat disintegration along the line of wire contact.

Details of the invention will become more readily understood from the following description when taken in conjunction with the accompanying drawings.

IN THE DRAWINGS

DESCRIPTION OF THE PREFERRED EMBODIMENTS

Figure 1:
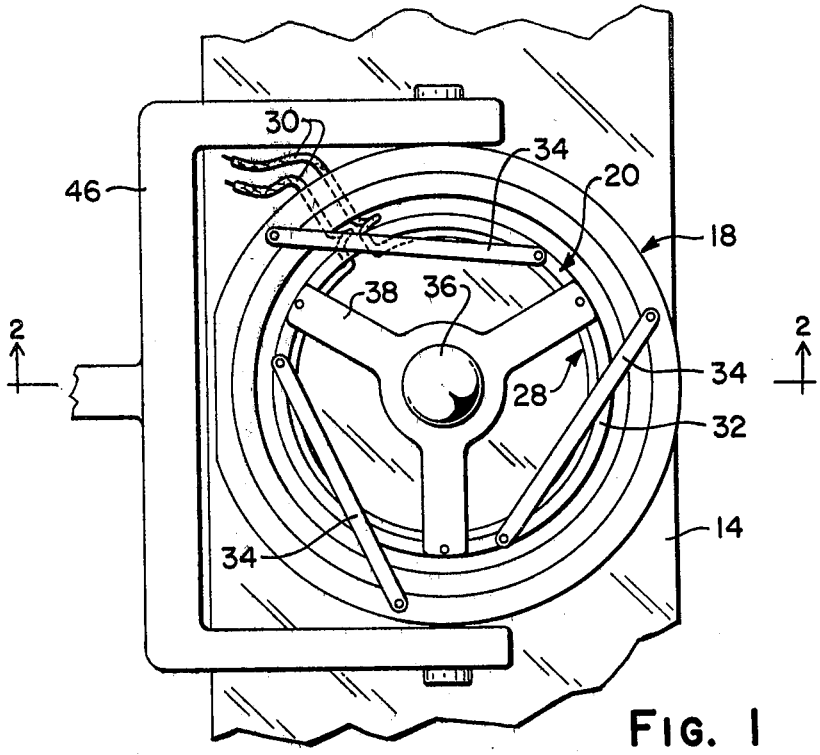
FIG. 1 is a plan view of lens taping apparatus embodying the present invention.
Figure 2:
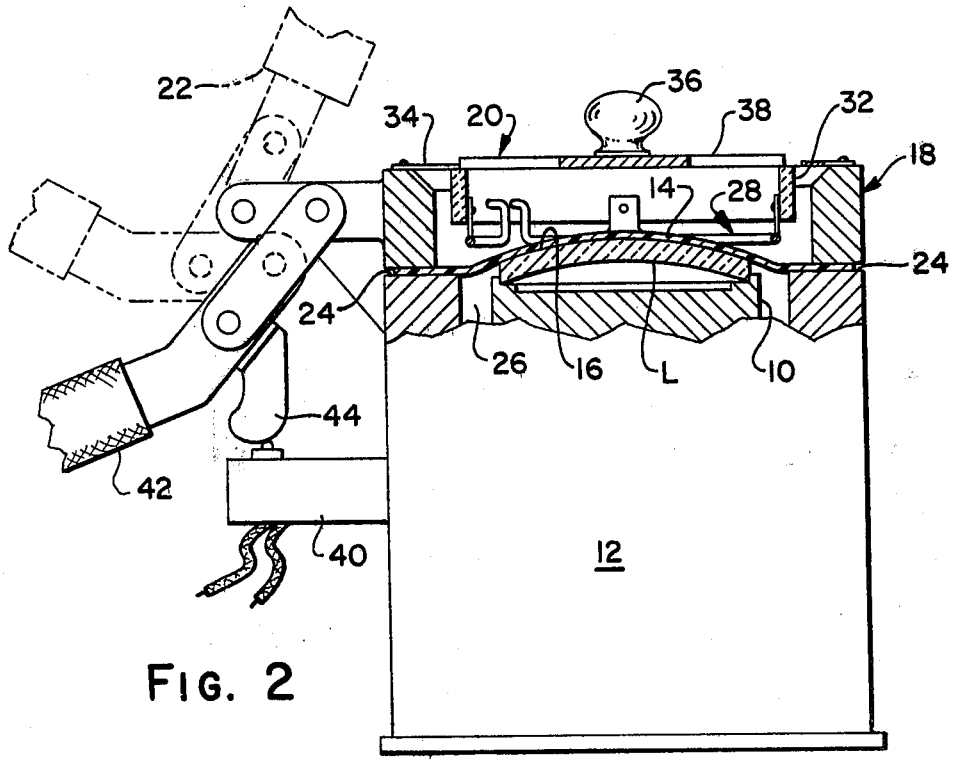
FIG. 2 is a cross-sectional view of the apparatus of FIG. 1 taken generally along line 2—2 of FIG. 1.

Referring to the drawings, the illustrated lens taping apparatus of FIGS. 1 and 2 comprises a lens support 10 on base 12 over which a length of tape 14 is drawn from a supply roll (not shown). The tape is drawn over the surface 16 of a lens L positioned upon support 10.

Clamp ring 18 carrying tape cutter 20 is pivotally supported on base 12 for swinging movement away from lens support 10 as indicated by broken lines 22 and into the position illustrated by full lines for clamping tape 14 against platen 24 of base 12 during application of the tape to lens L, e.g. by movement of support 10 upwardly. Partial vacuum may be effected in chamber 26 to facilitate tight and smooth taping of lens surface 16.

Tape 14 may comprise the commonly used transparent or colored, vinyl or polyethylene tape having a pressure sensitive adhesive backing. Such tape and applicator apparatus, to the extent thus far described (cutter 20 excepted) are currently commercially available from Armorlite, Inc., San Marcos, Calif., U.S.A. Other similar tapes and/or apparatuses may, of course, be used as will become apparent from the following description.

In the embodiment of the invention illustrated in FIGS. 1 and 2, cutter 20 comprises an electrical heating element in the form of a wire annulus 28. A suitable commercial heating wire is 17 gauge Kanthal A-1 (Iron-Chromium-Aluminum-Cobalt) made available by Kanthal Corp. of Bethel, Conn., U.S.A. This wire, having maximum operating temperature of approximately 1375° C., is preferably operated at approximately 375° C.

Annulus 28 is connected in series by electrical leads 30 to a suitable source of electrical current, not shown. A low electrical input of approximately 4 volts D.C. is preferred to minimize potential operator risk.

Annulus 28 is supported by sleeve 32 of dielectric material which, in turn, is suspended from the upper surface of ring 18 by leaf springs 34. Springs 34 hold the wire annulus 28 normally away from tape 14 while allowing its contact with tape 14 by selective manual depression of sleeve 32. For this purpose, operating knob 36 on Y-support 38 is fixed to sleeve 32.

Electrical switch 40 (FIG. 2) may be connected in circuit with leads 30 and used to automatically energize annulus 28 when ring 18 is swung downwardly against tape 14 and clamped in place with handle 42. Lever 44 on the handle mechanism will actuate switch 40.

With the foregoing means for hot wire cutting of tape 14, it can be seen that rapid, clean-cut trimming of a taped lens L can be accomplished simply, quickly and with reliable duplication, i.e. by simple depression of sleeve 32 with knob 36 and release. It is to be understood that the diametral size and circumferential shape of wire annulus 28 should be selected according to the shape and size of taped lenses L intended to be trimmed. Differently dimensioned wire 28, sleeve 32 units may be interchangeably spring mounted in ring 18. Alternatively, units including ring 18 may be rendered interchangeable in yoke 46 (FIG. 1).

Figure 3:
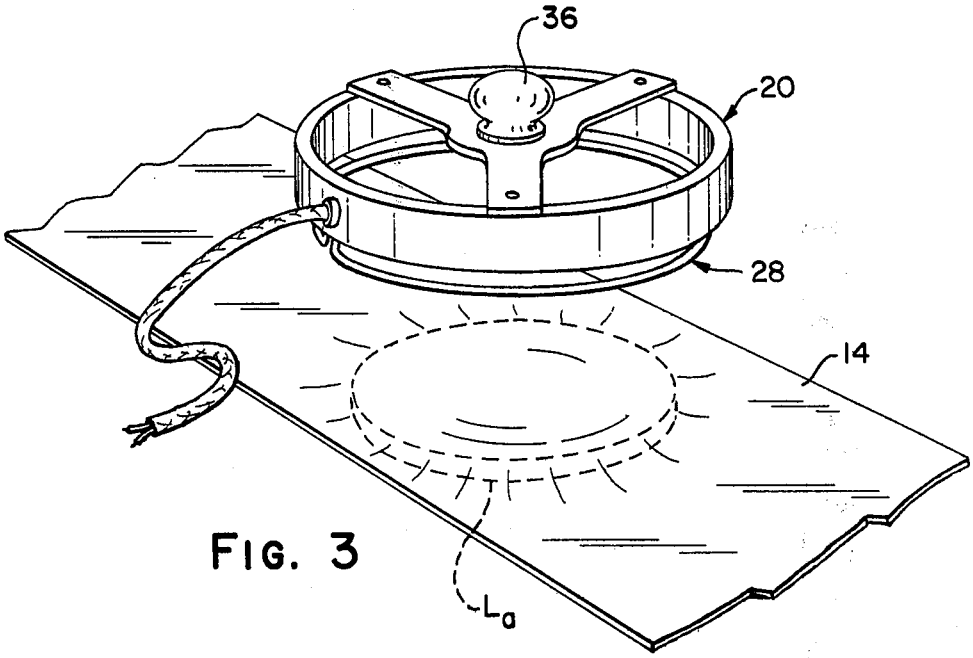
FIG. 3 is an illustration, in perspective, of an alternative embodiment of the invention.

As illustrated in FIG. 3, the cutter mechanism 20 may be used without ring 18 in cookie-cutter fashion if desired. By grasping handle 36, one may center the unit 20 over a taped lens $L_a$ or another taped article and engage the tape with heated wire 28.

It has been determined that by heating the wire annulus 28 to approximately 375° C., clean and rapid cutting (i.e. causing localized heat disintegration or burning) of polyethylene tape of the usual thickness of approximately 0.007 inch can be readily accomplished.

It is to be understood that use of the term "lens" herein is intended to include all forms of the article whether surface finished on one side only as mentioned above or on both sides and/or needing protection by taping and trimming for other than surfacing operations such as edge cutting, grinding or polishing and/or shipping and storage.

Those skilled in the art will readily appreciate that there are various modifications and adaptations of the precise forms of the invention here shown which may be made to suit particular requirements. Accordingly, presented illustrated forms of the invention are not to be interpreted as restricted beyond that necessitated by the following claims.

What is claimed is:

1. An apparatus for severing excess tape at the edges of a lens surface which has been covered with tape comprising:

a base, said base including a lens support;

a length of electrical heating wire formed in the shape of said lens, said lens-shaped wire having a diameter approximately the same as that of said lens;

a sleeve made of dielectric material, said sleeve supporting said lens-shaped wire;

a housing for said sleeve, said housing pivoting between a position away from said lens support and a position in which said housing covers said lens support;

at least two leaf springs, said at least two leaf springs suspending said sleeve from the upper surface of said housing;

an operating knob, said operating knob connected to a support, said support being fixed to said sleeve;

means for energizing said lens-shaped wire;

whereby when said ring is pivoted to a position covering said lens and said operating knob is depressed, said excess tape is severed from said tape covering said lens by said wire.

2. The apparatus for cutting tape of claim 1 wherein said means for energizing said lens-shaped wire comprises an electrical switch in an electrical circuit between a source of electrical energy and said wire, said switch normally electrically disconnecting said wire from said source of current and being operable at a selected time prior to contact of said wire with said tape for connecting said wire in electrical circuit with said current source and causing heating of said wire.

* * * * *